United States Patent [19]

Aiga et al.

[11] Patent Number: 5,049,782

[45] Date of Patent: Sep. 17, 1991

[54] MAGNETRON WITH HARMONIC SUPPRESSION MEANS

[75] Inventors: Masayuki Aiga; Kazuki Miki, both of Hyogo, Japan

[73] Assignee: Sanyo-Electric Co., Ltd., Osaka, Japan

[21] Appl. No.: 303,929

[22] Filed: Jan. 30, 1989

[30] Foreign Application Priority Data

Feb. 3, 1988 [JP] Japan ..... 63-24584

[51] Int. Cl.[5] ..... H01J 25/50

[52] U.S. Cl. ..... 315/39.51; 315/39.69; 315/39.75; 313/333; 313/238

[58] Field of Search ..... 315/39.69, 39.51, 39.57, 315/39.75, 5.13; 313/38, 238, 333, 397

[56] References Cited

U.S. PATENT DOCUMENTS

| | | | |
|---|---|---|---|
| 2,454,031 | 11/1948 | Bondley | 315/40 |
| 2,957,100 | 10/1960 | Espersen | 313/107 |
| 3,537,042 | 10/1970 | Simmen | 333/206 |
| 3,659,232 | 4/1972 | Foley | 333/206 |
| 4,006,382 | 2/1977 | Butler et al. | 315/39.53 |
| 4,074,169 | 2/1978 | Harada | 315/39.75 |
| 4,223,246 | 9/1980 | Osepchuk | 315/39.71 |
| 4,459,563 | 7/1984 | Kawaguchi | 331/91 |
| 4,720,659 | 1/1988 | Aiga et al. | 315/39.69 |
| 4,742,272 | 5/1988 | Kusano et al. | 315/39.69 |

FOREIGN PATENT DOCUMENTS

| | | | |
|---|---|---|---|
| 3614852 | 6/1986 | Fed. Rep. of Germany . | |
| 1200354 | 12/1959 | France . | |
| 13248 | 1/1979 | Japan | 315/39.69 |
| 7333 | 1/1981 | Japan | 315/39.69 |
| 32946 | 7/1985 | Japan . | |
| 45340 | 10/1986 | Japan . | |

*Primary Examiner*—Eugene R. Laroche
*Assistant Examiner*—Benny Lee
*Attorney, Agent, or Firm*—Darby & Darby

[57] ABSTRACT

In an interaction space (4) defined between a cathode (3) and forward end portions of vanes (2), a permanent magnet (12) applies a uniform direct-current magnetic field along an axial direction of the cathode (3). Direct-current or low-frequency high voltage is applied between the cathode (3) and the respective vanes (2). Spaces (14) enclosed by respective pairs of adjacent vanes (2) and the inner wall of an anode cylinder (1) define cavity resonators. High-frequency electric fields formed in the cavity resonators are concentrated to the forward end portions of the vanes (2), and partially leak into the interaction space (4). Under such conditions, an electron group emitted from the cathode (3) rotates about the cathode (3) in the interaction space (4), thereby interaction takes place between the electron group and the high-frequency electric fields, to oscillate microwaves. The inner surface of a flange part (6) of a top hat (7) supporting one end of a filament (5) of the cathode (3) is located in a position closer to the interaction spaces (4) by length within a range of 0.1 to 0.6 mm from first end surfaces of the vanes (2) along the axial direction, thereby to suppress undesired fifth harmonic generated with the microwaves of a basic frequency at this time.

16 Claims, 6 Drawing Sheets

MAGNETRON WITH HARMONIC SUPPRESSION MEANS

BACKGROUND OF THE INVENTION

1. Field of the Invention

The present invention relates to a magnetron which is applied to a microwave oven or the like, and more particularly, it relates to a magnetron which has a cathode provided with an improved end shield.

2. Description of the Prior Art

FIG. 1 is a typical diagram schematically showing the structure of a microwave oven, for example, to which a magnetron is applied. Referring to FIG. 1, a microwave oven 1000 has a magnetron 100, a driving power source 200 for driving the magnetron 100 and a waveguide 300. The entire microwave oven 1000 is covered with a microwave oven cover 400. Microwaves oscillated from the magnetron 100 are guided into an internal space 500 of the microwave oven 1000 through the waveguide 300. Food 700 placed on a pan 600 is heated and cooked by such microwaves.

FIG. 2A is a partially fragmented front elevational view showing the structure of a conventional magnetron which is disclosed in Japanese Patent Publication Gazette No. 45340/1986, for example. FIG. 2B is a partial sectional view taken along the line IIB—IIB in FIG. 2A. FIG. 2C is a partial sectional view taken along the line IIC—IIC in FIG. 2B. The structure of such a typical conventional magnetron is now described with reference to these figures.

Referring to FIGS. 2A to 2C, a magnetron 100 is provided with a cathode 3 in its central portion. The cathode 3 has a filament 5 (see FIG. 2*c*), which emits electrons. A plurality of panel-shaped vanes 2 of oxygen free copper or the like are radially arranged to encircle the cathode 3. The vanes 2 have base end portions which are fixed to the inner wall of an anode cylinder 1 of oxygen free copper, or integrally formed with the anode cylinder 1. Two inner strap rings 9, which are selected to be identical in diameter to each other, are provided on upper and lower ends (in FIGS. 2A and 2C) of the vanes 2. The inner strap rings 9 are arranged in positions separated by a l prescribed distance from the forward end portions of the vanes 2 (see FIG. 2*c*) with respect to the full length L of the vanes 2. Further, two outer strap rings 10, which are selected to have the same diameters, being larger than those of the inner strap rings 9, are provided on the upper and lower ends of the vanes 2. The inner and outer strap rings 9 and 10 are so fixed to the vanes 2 as to short-circuit every other vane 2. In other words, the upper one of the inner strap rings 9 and the lower one of the outer strap rings 10 are fixed to the same alternately-arranged vanes 2, while the upper one of the outer strap rings 10 and the lower one of the inner strap rings 9 are fixed to the remaining vanes 2 respectively. The respective adjacent vanes 2 and the inner wall of the anode cylinder 1 define spaces 14 (see FIG. 2*b*)partially opened toward the cathode 3, thereby to form cavity resonators. The oscillation frequency of the magnetron 100 is determined by the resonance frequency of such cavity resonators. In a central portion of the anode cylinder 1, a cylindrical space is axially defined by the forward end portions of the vanes 2. The cathode 3 is arranged in this space. The space 4 thus held between the cathode 3 and the vanes 2 at a prescribed distance is called an interaction space. A uniform direct-current magnetic field is applied to the interaction space 4 in parallel with the central axis of the cathode 3. To this end, permanent magnets 12 are arranged in the vicinity of upper and lower ends of the anode cylinder 1 respectively (see FIG. 2*a*). Direct-current or low-frequency high voltage is applied between the cathode 3 and the vanes 2.

In FIG. 2*c*, the cathode 3 is formed by the filament 5, which is helically prepared from tungsten containing thorium or the like, a top hat 7 supporting the upper end of the filament 5 and having a flange part 6 which is larger in outer diameter than the filament 5 in its upper portion and an end hat 8 supporting the lower end of the filament 5. The top hat 7 and the end hat 8 are formed of a metal having a high melting point, such as molybdenum. The top hat 7 and the end hat 8 are adapted to prevent axial deviation of electrons from the filament 5. Alternate ones of the vanes 2 are electrically connected with each other since the inner strap rings 9 and the outer strap rings 10 are alternately fixed to the upper and lower ends of the vanes 2, as hereinabove described. An antenna conductor 11 (see FIGS. 2*a*, 2*c*) is so provided that an end thereof is connected with one of the vanes 2.

In the aforementioned structure, high-frequency electric fields formed in the cavity resonators are concentrated to the forward end portions of the respective vanes 2, and partially leak into the interaction space 4. Since the inner and outer strap rings 9 and 10 couple alternate ones of the vanes 2, the respective adjacent vanes 2 are at reverse potentials in high frequency. An electron group emitted from the cathode 2 rotates about the cathode 3 in the interaction space 4, whereby interaction takes place between the electron group and the high-frequency electric fields, to cause oscillation of microwaves. The microwaves obtained by such oscillation are outwardly guided through the antenna conductor 11 which is connected with one of the vanes 2. Since conversion efficiency into microwave power is not 100%, the energy of the electron group is partially consumed as heat. Therefore, fins 13 (see FIG. 2*a*) are provided along the outer circumference of the anode cylinder 1 for radiating the heat. FIG. 2B, 2C shows only the internal structure of the anode cylinder 1, and fins 13 etc. are not shown in this figure.

International Standards are established by ITU (International Telecommunication Union) for the aforementioned magnetron, and the basic frequency of 2450 MHz is allocated to food heating apparatuses, medical appliances, parts of industrial instruments and the like. In such application, therefore, the magnetron 100 ideally oscillates only microwaves at the basic frequency of 2450 MHz (±50 MHz), whereas the same generates various higher harmonics in practice. Within such higher harmonics, particularly the fifth harmonic having a frequency of 12.25 GHz (±0.25 GHz), there is an overlap with a working frequency range of satellite broadcasting, which has been tested since around 1981 and more recently has been in use, creates serious problems. For example, while radio frequency allocation for SHF satellite broadcasting is varied with areas of nations, the frequency range thereof is set in a range of 11.7 to 12.75 GHz.

In the magnetron having the aforementioned structure, further, the filament 5 is abnormally heated by generation of cathode back bombardment, whereby the filament 5 may be fused in an extreme case.

SUMMARY OF THE INVENTION

An object of the present invention is to provide a magnetron, which can suppress undesired higher harmonics, particularly the fifth harmonic, as well as cathode back bombardment.

The magnetron according to the present invention comprises an anode cylinder, vanes, an antenna conductor, strap ring means, a cathode and magnet means. A plurality of panel-shaped vanes are provided on the inner wall of the anode cylinder toward the center of the anode cylinder. The vanes, which are separated from each other at intervals, have edges provided on forward end portions thereof and first and second end surfaces along an axial direction of the anode cylinder. The antenna conductor is electrically connected with the first end surface, along the axial direction, of one of the vanes. The strap ring means electrically couples alternate ones of the vanes with each other. The cathode is provided in the anode cylinder to extend along the axial direction of the anode cylinder in relation separated from the edges of the forward end portions of the vanes. Thus, an interaction space is defined between the edges of the forward end portions of the vanes and the cathode. The cathode comprises a filament, a first end shield and a second end shield. The filament is provided to extend along the axial direction of the anode cylinder. The first end shield supports a first end, along the axial direction, of the filament and has a flange part which is larger in outer diameter than the filament. This flange part has an inner surface facing the interaction space. The second end shield supports a second end, along the axial direction, of the filament. The magnet means is adapted to provide a magnetic field in the interaction space along the axial direction of the anode cylinder. The magnetron generates microwaves of a prescribed basic frequency, while inevitably generating higher harmonics accompanying the basic frequency. The first end shield is so provided that the inner surface of the flange part thereof is located in a position closer to the interaction space by length within a range of 0.1 to 0.6 mm from the first ends of the vanes along the axial direction, thereby to suppress generation of the fifth harmonic.

In a magnetron according to another aspect of the present invention, the strap ring means has an inner diameter which is so selected that the ratio l/L exceeds a prescribed minimum value calculated to highly suppress generation of the fifth harmonic of the basic frequency. Symbol l represents the distance between the inner peripheral surface of the strap ring means and the edges of the forward end portions of the vanes, and L represents the length of the vanes.

According to a preferred embodiment of the present invention, the first end shield is so provided that the inner surface of the flange part is located in a position closer to the interaction space by length within a range of 0.2 to 0.4 mm from the first end surfaces of the vanes along the axial direction. The basic frequency may be selected within a range of 2400 to 2500 MHz.

According to the present invention, generation of undesired higher harmonics, particularly the fifth harmonic, can be efficiently suppressed without adding new structure to the conventional magnetron but by simply changing part of its structure, i.e., the position of the flange part of the first end shield, within a technically limited range. Further, generation of cathode back bombardment can be also suppressed.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
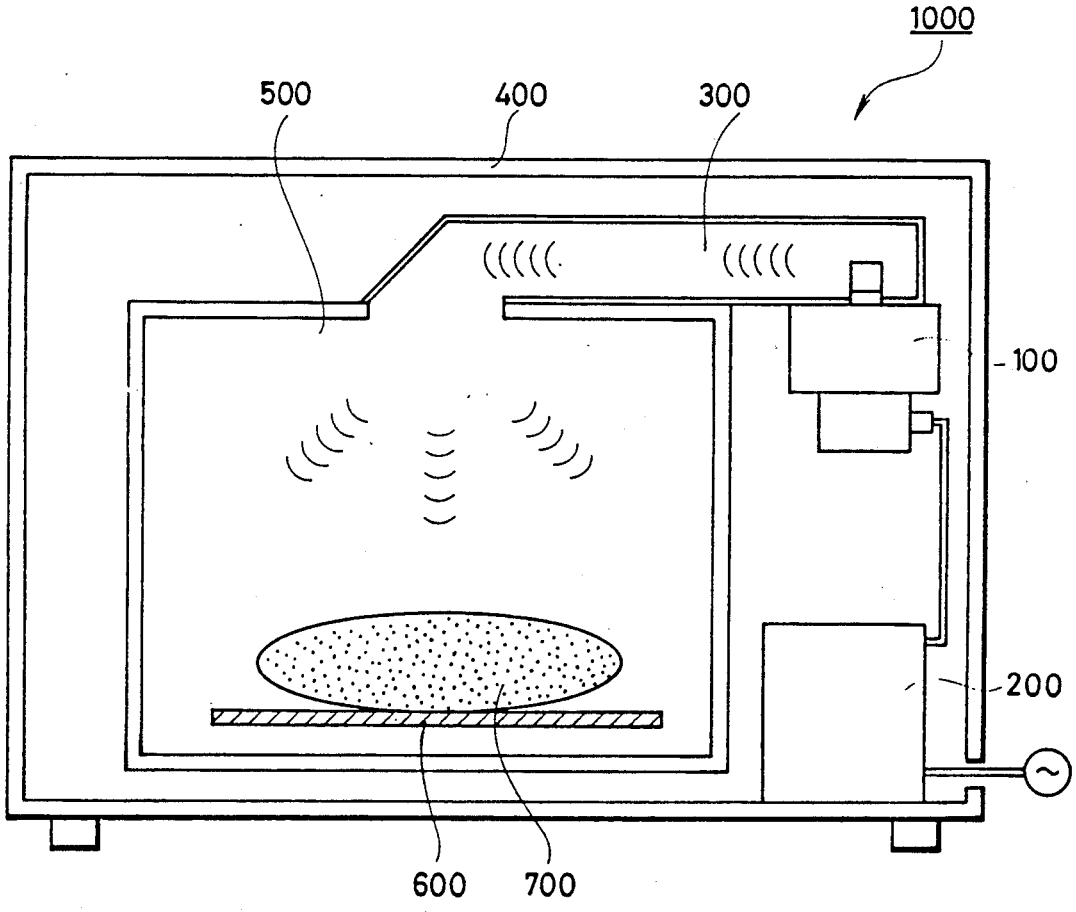
FIG. 1 PRIOR ART
FIG. 1 is a typical diagram schematically showing the structure of a conventional microwave oven, as an exemplary apparatus to which a magnetron is applied.

The inventors have found that one of the causes for the aforementioned higher harmonics and cathode back bombardment may be the position of the cathode. In the structure of the conventional magnetron shown in FIG. 2C, the lower surface of the flange part 6 of the top hat 7 supporting the upper end of the cathode 3 is positioned above the upper ends of the vanes 2. For example, the space a between the lower surface of the flange part 6 and the upper ends of the vanes 2 is set at about 0.4 to 0.6 mm. In such conventional structure, a high-frequency electric field of the antenna conductor 11 exerts influence on the interaction space 4, to disturb electric field distribution in the interaction space 4. It is considered that smooth movement of the electrons is thus prevented, to cause higher harmonic noise and cathode back bombardment. The present invention is adapted to provide the lower surface of a flange part of a top hat supporting the upper end of a filament in a position lower than the upper ends of vanes by a prescribed distance, thereby to suppress generation of the fifth harmonic and cathode back bombardment.

For example, each of Japanese Patent Publication Gazette No. 32946/1985 and U.S. Pat. No. 4,223,246 discloses the structure of a magnetron in which the lower surface of a flange part of a top hat supporting the upper end of a filament is provided in a position lower than upper ends of vanes similarly to the present invention. However, such literature merely illustrates positional relation between the lower surface of the flange part of the top hat and the upper ends of the vanes, but makes no description of technical significance of such positional relation. This may be because it was not necessary to consider higher harmonics caused by a magnetron in patent applications for the aforementioned examples, which were filed in 1979 before starting of a test for satellite broadcasting. Thus, it is clear that no one has found that positional relation between the lower surface of a flange part of a top hat and the upper ends of vanes is related to the generation level of fifth harmonic noise. Further, it has been common knowledge for those skilled in the art to position the lower surface of the flange part of the top hat above the upper ends of the vanes as shown in FIG. 2C, in order to attain stable oscillation in a $\pi$-mode. The present invention has attained its object of suppressing generation of the fifth harmonic with no regard to such conventional technical knowledge, and is not anticipated by the aforementioned two examples. Although the lower surface of a flange part of a top hat is provided in a position lower than the upper ends of vanes according to the present invention, stable oscillation in a $\pi$-mode is not prevented by such structure, as clarified in the following description.

Figure 2A:
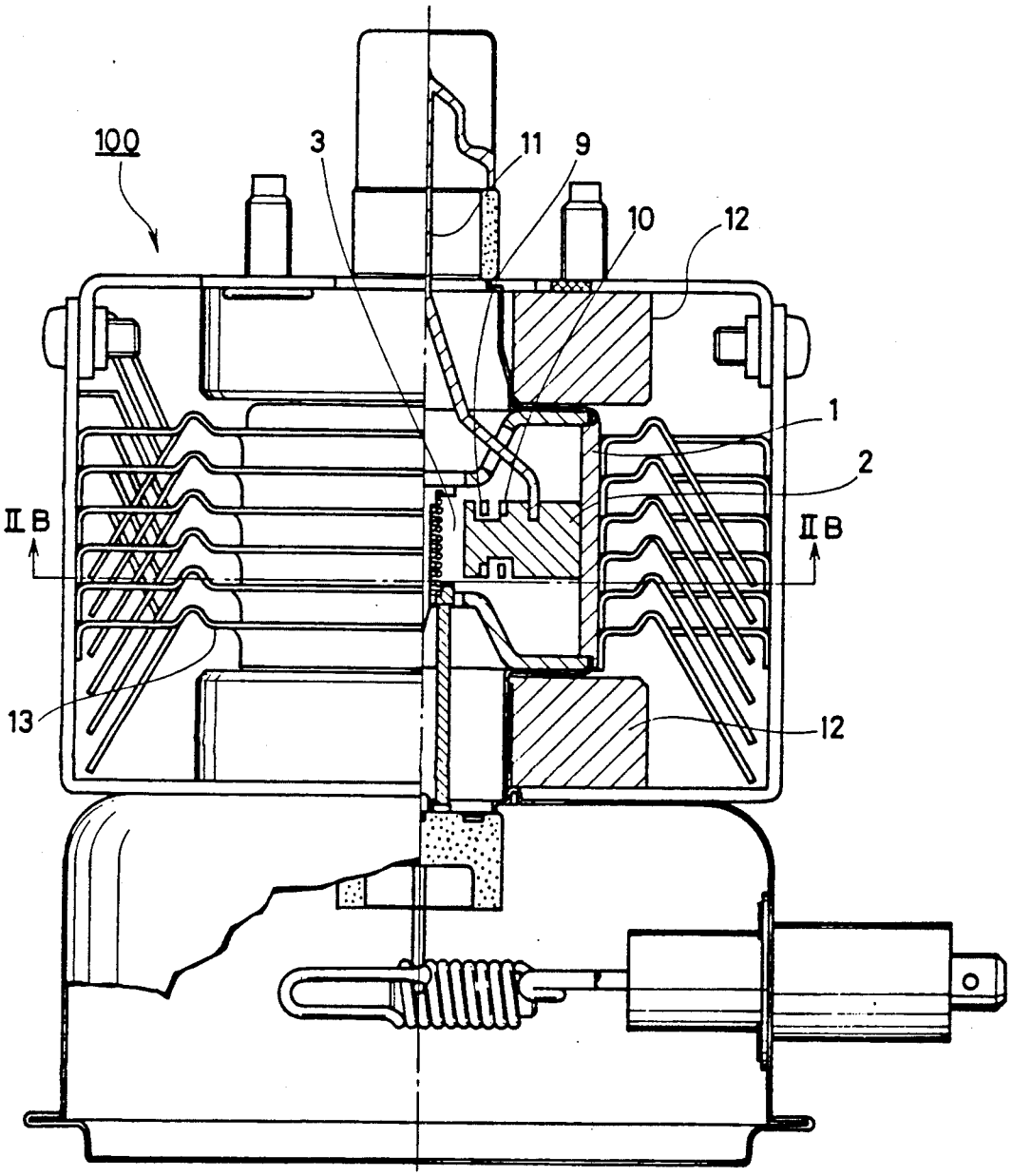
FIG. 2A PRIOR ART
FIG. 2A is a partially fragmented front elevational view showing the structure of a conventional magnetron.
Figure 2B:
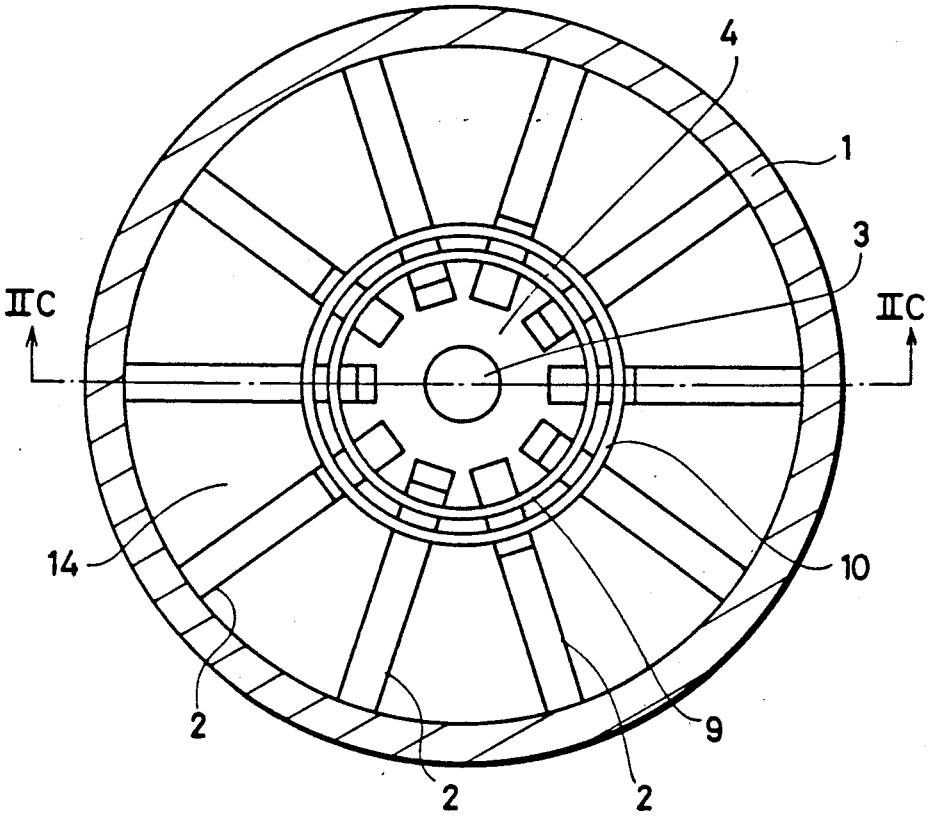
FIG.2B PRIOR ART
FIG. 2B is a partial sectional view taken along the line IIB—IIB in FIG. 2A.
Figure 2C:
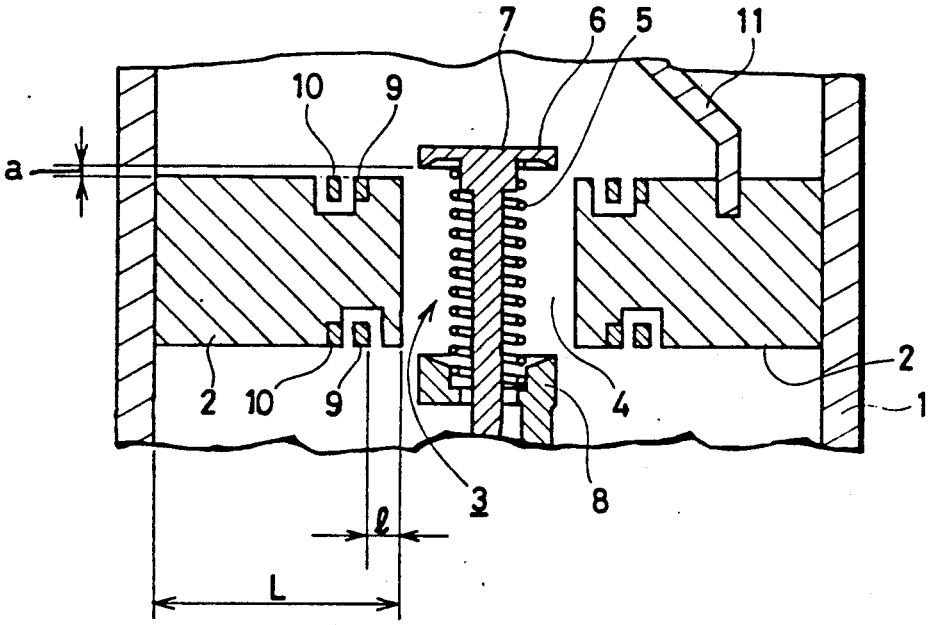
FIG.2C PRIOR ART
FIG. 2C is a partial sectional view taken along the line IIC—IIC in FIG. 2B.
Figure 3:
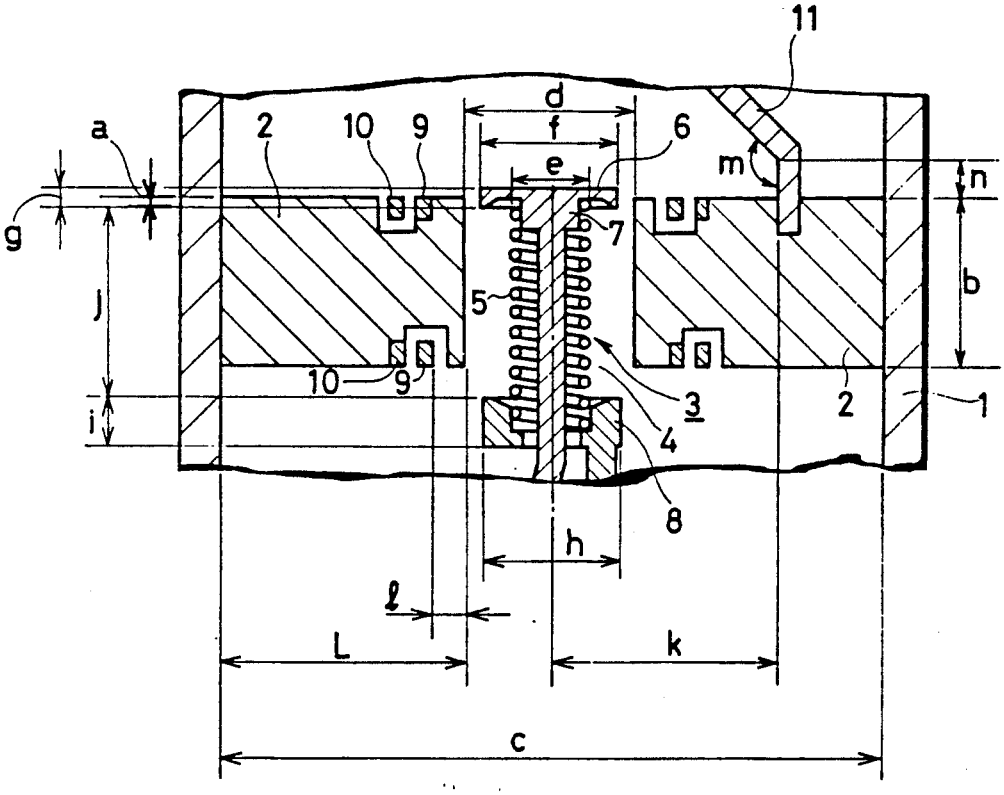
FIG. 3 is a partial sectional view showing a magnetron according to the present invention, in correspondence to FIG. 2C.

FIG. 3 is a partially enlarged sectional view illustrating an embodiment of the present invention in correspondence to FIG. 2C showing the conventional magnetron. Referring to FIG. 3, this embodiment is identical in structure to the conventional magnetron shown in FIG. 2C, except for positional relation between a flange part 6 of a top hat 7 and vanes 2. A cathode 3 is provided in a lower portion, and the lower surface of the flange part 6 of the top hat 7 is provided in a position lower than the upper ends of the vanes 2.

It is assumed that respective dimensions (a–n) shown in FIG. 3 are set at the following values, for example:

Space a between the lower surface of the flange part 6 at the top hat 7 and the upper ends of the vanes 2: dimension is variable as shown in FIGS. 4 to 7.

Vertical length b of the vanes 2: dimension is variable as shown in FIGS. 4 to 7.

Inner diameter c of anode cylinder 1: 35.0 mm.

Space d between each pair of opposite vanes 2: 9.0 mm.

Outer diameter e of filament 5: 4.0 mm.

Outer diameter f of flange part 6 of top hat 7: 7.2 mm.

Thickness g of flange part 6: 1.0 mm.

Outer diameter h of end hat 8: 7.2 mm.

Vertical length i from upper surface to lower surface of end hat 8: 2.5 mm.

Vertical distance j between lower surface of flange part 6 of top hat 7 and upper surface of end hat 8: 9.8 mm.

Distance k between axis of anode cylinder 1, i.e., axis of cathode 3 and position of antenna conductor 11 mounted on one vane 2: 12.9 mm.

Length L of vane 2: 13.0 mm.

Distance l between inner peripheral surface of inner strap ring 9 and forward end portion of vane 2: 3.25 mm.

Distance n between vane 2 and bent portion of antenna conductor 11: 2.0 mm.

Angle m of bending of bent portion of antenna conductor 11: 145°.

FIGS. 4 to 7 show results of measurement obtained with the respective dimensions set as above. Characteristics of the inventive magnetron are now described with reference to these characteristic diagrams.

Figure 4:
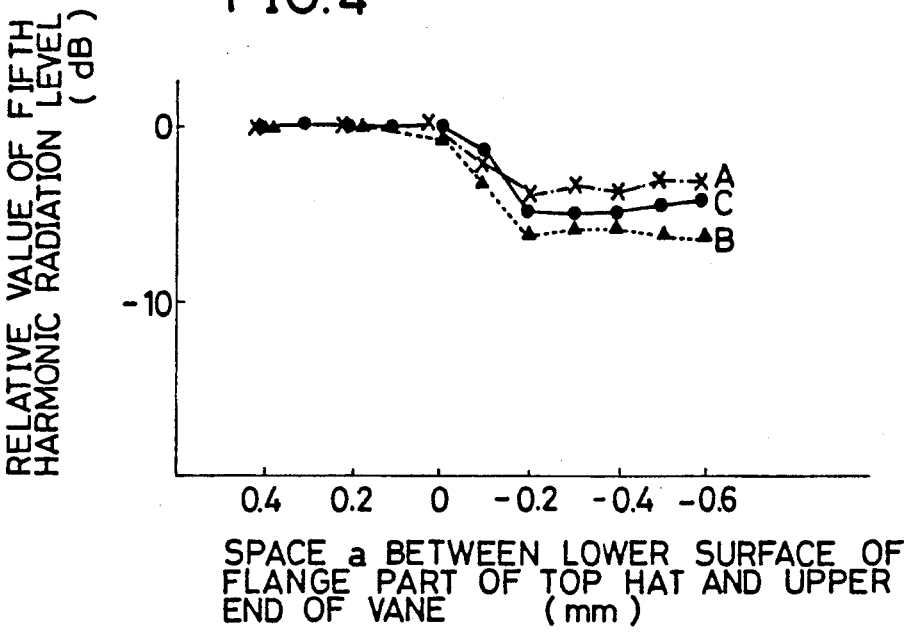
FIG. 4 is a characteristic diagram showing relation of a space (a) between the lower surface of a flange part of a top hat and upper ends of vanes to the level of fifth harmonic radiation in the present invention.

FIG. 4 is a characteristic diagram prepared on the basis of experimental data for showing how the fifth harmonic radiation level is varied with the space a between the lower surface of the flange part 6 of the top hat 7 and the upper ends of the vanes 2. Referring to FIG. 4, the vertical length b of the vanes 2 is varied with curves A, B and C as follows:

A:b=9.6 mm

B:b=9.2 mm

C:b=8.8 mm

The space a between the lower surface of the flange part 6 of the top hat 7 and the upper ends of the vanes 2 is at a positive value when the lower surface of the flange part 6 is positioned above the upper ends of the vanes 2, while the same is at a negative value when the lower surface of the flange part 6 is positioned under the upper ends of the vanes 2, in each characteristic diagram. Further, the magnetron is supplied with voltage of 4 kV and anode current of 300 mA. FIG. 4 shows the fifth harmonic radiation level as a relative value based on the radiation level in case of a=0.4 mm.

When the vertical position of the top hat 7 is lowered, substantially no change is caused in the relative value of the fifth harmonic radiation level until the value a reaches zero, i.e., until the lower surface of the flange part 6 of the top hat 7 is flush with the upper ends of the vanes 2, as seen from FIG. 4. Reduction of the relative value of the fifth harmonic radiation level starts when the lower surface of the flange part 6 is lower by 0.1 mm the upper ends of the vanes 2. It is understood that, when the lower surface of the flange part 6 is lower than the upper ends of the vanes 2 by at least 0.2 mm, the relative value of the fifth harmonic radiation level substantially reaches a constant value which is lower than that in the case of a=−0.1 mm.

In order to suppress generation of the fifth harmonic, therefore, it is preferable to provide the lower surface of the flange part 6 of the top hat 7 in a position lower than the upper ends of the vanes 2 by at least 0.1 mm, and more preferably, by at least 0.2 mm.

Figure 5:
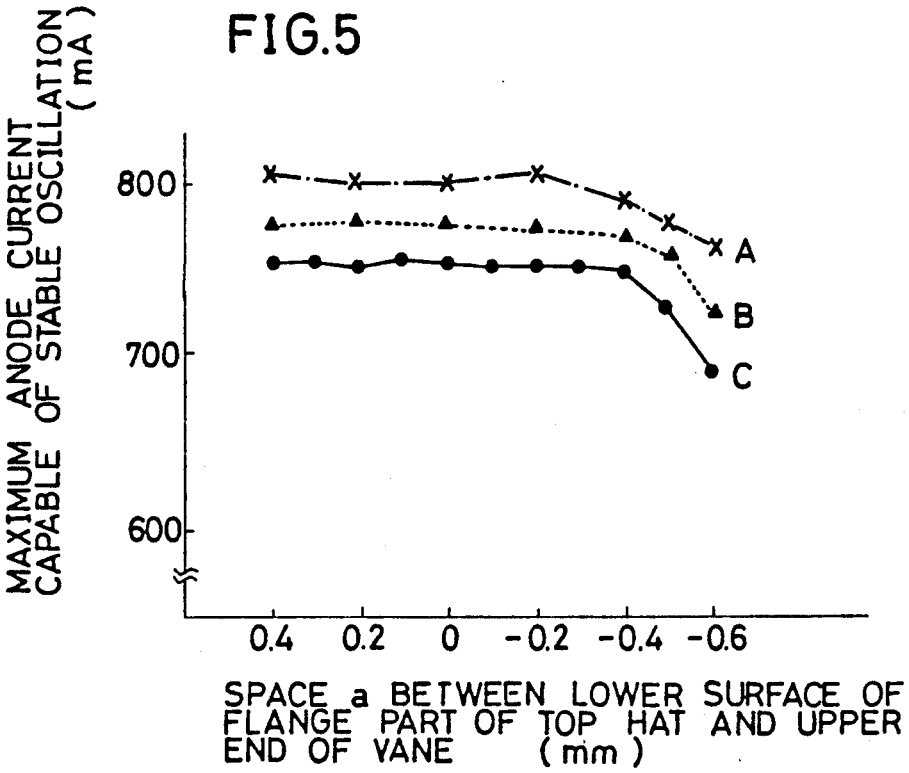
FIG. 5 is a characteristic diagram showing relation of the space (a) between the lower surface of the flange part of the top hat and the upper ends of the vanes to the maximum anode current which is capable of stable oscillation in the present invention.

FIG. 5 is a characteristic diagram prepared on the basis of experimental data, for illustrating how the critical point of a moding, in which a regular high-frequency electric field of a $\pi$-mode in the magnetron is so disturbed that the $\pi$-mode cannot be correctly maintained, is varied with the space a between the lower surface of the flange part 6 of the top hat 7 and the upper ends of the vanes 2, in maximum anode current capable of stable oscillation. Similarly to FIG. 5, the vanes are 9.6 mm, 9.2 mm and 8.8 mm in vertical length b in curves A, B and C respectively.

When the vertical position of the top hat 7 is lowered, the critical point of the maximum anode current which is capable of stable oscillation is substantially at a constant value until the lower surface of the flange part 6 of the top hat 7 reaches a position lower by 0.4 mm than the upper ends of the vanes 2, as seen from FIG. 5. It is understood that, when the lower surface of the flange part 6 is in a position lower than the upper ends of the vanes 2 by at least 0.4 mm, the anode current value is reduced with downward movement of the said lower surface. There is the possibility that stable oscillation cannot be maintained in a microwave oven etc. to which the magnetron is applied, when the anode current value serving as the critical point is not more than 700 mA.

In order to attain stable oscillation, therefore, the limit for downwardly moving the lower surface of the flange part 6 of the top hat 7 is a position lower by 0.6 mm than the upper ends of the vanes 2. If the lower surface of the flange part 6 is further downwardly moved, stable oscillation cannot be suitably attained. Thus, it is desirable to provide the lower surface of the flange part 6 in a position lower by 0.4 mm than the upper ends of the vanes 2, in order to attain good stable oscillation.

Figure 6:
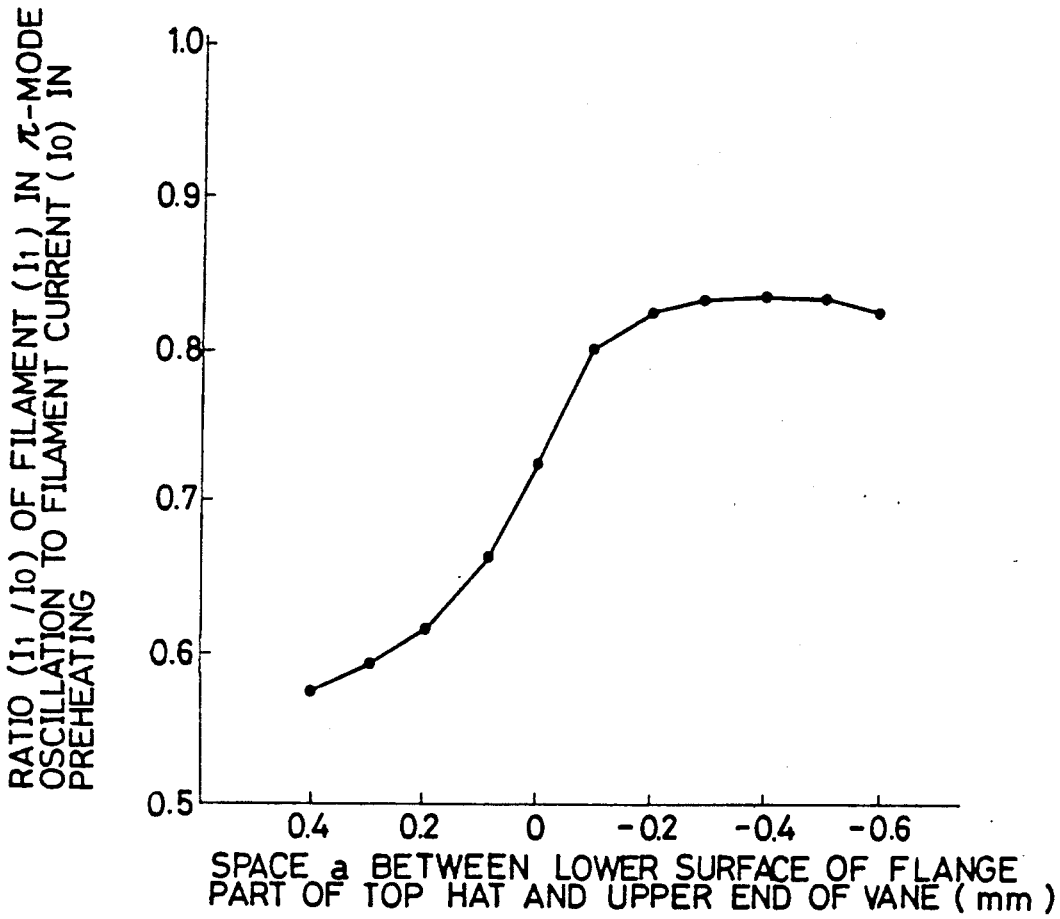
FIG. 6 is a characteristic diagram showing relation of the space (a) between the lower surface of the flange part of the top hat and the upper ends of the vanes to the ratio of filament current in preheating to that in $\pi$-mode oscillation in the present invention.

FIG. 6 is a characteristic diagram prepared on the basis of experimental data, for illustrating the degree of generation of anode back bombardment caused when the space a between the lower surface of the flange part 6 of the top hat 7 and the upper ends of the vanes 2 is changed, in the ratio ($I_1/I_0$) of filament current ($I_1$) in $\pi$-mode oscillation to filament current $I_0$) in preheating. The vertical length b of the vanes 2 is 8.8 mm in this case.

As seen from FIG. 6, the ratio ($I_1/I_0$) is increased as the vertical position of the top hat 7 is lowered. It is understood that the ratio ($I_1/I_0$) reaches a substantially constant value when the lower surface of the flange part 6 of the top hat 7 is provided in a position lower by at least 0.1 mm than the upper ends of the vanes 2.

When cathode back bombardment is caused in oscillation, the temperature of the filament 5 is raised to increase filament resistance, whereby the filament current ($I_1$) is reduced. Thus, it is considered that generation of cathode back bombardment is reduced as the ratio ($I_1/I_0$) is increased. In other words, it is understood that generation of cathode back bombardment is reduced as the vertical position of the top hat 7 is lowered.

In order to suppress generation of cathode back bombardment, therefore, it is preferable to provide the lower surface of the flange part 6 of the top hat 7 in a position lower than the upper ends of the vanes 2 by at least 0.1 mm, and more preferably, at least 0.2 mm.

It is understood from the characteristic diagrams shown in FIGS. 4 to 6 that the space a between the lower surface of the flange part 6 of the top hat 7 and the upper ends of the vanes 2 is preferably within a range of $-0.6\ \text{mm} \leqq a \leqq -0.1$ mm, and most preferably within a range of $-0.4\ \text{mm} \leqq a \leqq 0.2$ mm. It is considered that, when the value a is set in such a range, the high-frequency electric field of the antenna conductor 11 hardly enters the interaction space and disturbance in electric field distribution within the interaction space is suppressed while electrons can smoothly move in the interaction space, whereby generation of higher harmonics and cathode back bombardment can be suppressed.

Figure 7:
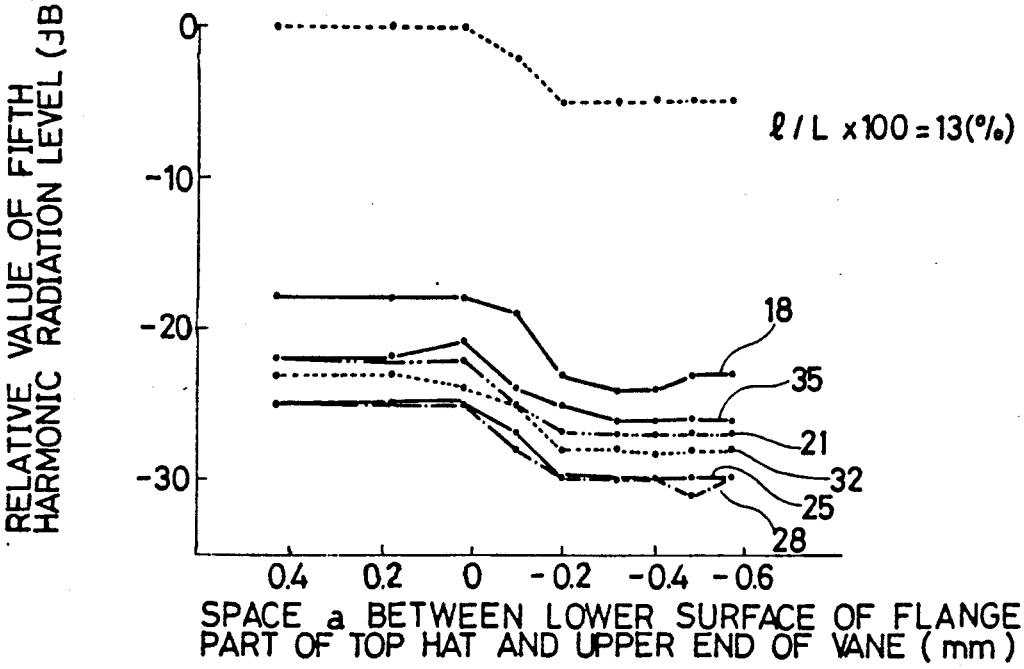
FIG. 7 is a characteristic diagram showing relation of the space (a) between the lower surface of the flange part of the top hat and the upper ends of the vanes, the inner diameter of an inner strap ring and the level of fifth harmonic radiation in the present invention.

FIG. 7 is a characteristic diagram prepared on the basis of experimental data for showing the level of fifth harmonic radiation varied with positions of inner strap rings 9 and outer strap rings 10 in the magnetron shown in FIG. 3. Curves shown in FIG. 7 represent relative values of the fifth harmonic radiation level obtained when values of $l/L \times 100$ are 13, 18, 21, 25, 28, 32 and 35 respectively. Such relative values of the fifth harmonic radiation level are on the basis of a value obtained when $l/L \times 100 = 13\%$ and $a = 0.4$ mm. The vertical length b of the vanes 2 is 8.8 mm in this case. Symbol L indicates the full length of the vanes 2 shown in FIG. 3, and symbol l indicates the distance between the forward end portions of the vanes 2 and the inner peripheral surface, i.e., a surface facing the cathode 3, of each inner strap ring 9. The space between the inner and outer strap rings 9 and 10 is regularly at a constant value of 0.8 mm.

It is understood from FIG. 7 that the fifth harmonic radiation level is extremely reduced as the position of each inner strap ring 9 is separated from the forward end portions of the vanes 2. Particularly when the position of the inner strap ring 9 is within a range of at least 18% and at most 35% with respect to the full length L of the vanes 2 from the forward end portions of the vanes 2, generation of the fifth harmonic can be extremely suppressed. Preferably the range is at least 21% and at most 32%.

U.S. Pat. No. 4,720,659 in the name of the inventors discloses the technique of separating the strap rings from the forward end portions of the vanes by constant distances in order to suppress generation of the fifth harmonic radiation level. When the lower surface of the flange part 6 of the top hat 7 is provided in a position lower than the upper ends of the vanes 2 in addition to the aforementioned positional setting of the strap rings, it is possible to further suppress generation of the fifth harmonic radiation level, as shown in FIG. 7.

The relative values of the fifth harmonic radiation level shown in FIG. 4 are different from those shown in FIG. 7, due to difference in reference values of the fifth harmonic radiation level. FIG. 4 is based on the fifth harmonic radiation level obtained when $l/L \times 100 = 13\%$ and $a = 0.4$ mm, while FIG. 7 is based on the fifth harmonic radiation level obtained when $l/L \times 100 = 13\%$ and $a = 0.4$ mm.

Although the above description has been made with reference to a magnetron which has the basic frequency of 2450 MHz, the present invention is not restricted to this, but is also applicable to a magnetron whose basic frequency is selected at any value in a frequency range of 2400 to 2500 MHz, for example, and that having a basic frequency out of such a range.

FIG. 2A merely shows an exemplary conventional magnetron, and FIG. 3 shows exemplary structure of a principal part in case of applying the present invention in the entire structure of the magnetron shown in FIG. 2A. It is also possible to apply the present invention to another magnetron having slight modification.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A magnetron for generating microwaves of a predetermined basic frequency and which harmonics higher than the basic frequency also may be produced, the magnetron comprising:

an anode having a cylindrical shape relative to a central axis;

a cathode extending radially inside of said anode and extending in an axial direction along said central axis, said cathode having a filament defined by a width and first and second ends between which said filament extends along said central axis, said cathode having a first end shield which supports said first end of said filament, said first end shield having a flange part with an outer diameter which is greater than the width of said filament, said cathode also having a second end shield which supports said second end of said filament;

a plurality of panel-shaped vanes extending from said anode towards said central axis, each of said vanes being spaced from each other and having a periphery which includes first and second end surface which extend from said anode towards said central axis, each said periphery also including an edge extending between said first and second end surfaces, said vanes being spaced from said cathode so as to define an interaction space bounded between said edge, said cathode, and where projections extending radially inward from said first and second end surfaces to said central axis would lie, an antenna conductor electrically connected to said first end surface of one of said vanes extending in said axial direction;

strap ring means for electrically coupling alternate ones of said vanes with each other at said first end surfaces;

magnetic field providing means for providing a magnetic field in said interaction space, said magnetic field providing means including opposing magnetic elements, said anode and said interaction space being between said opposing magnetic elements of said magnetic field providing means; and means for suppressing generation of a fifth harmonic, said suppressing means including said flange part of said first end shield having an inner surface located in said interaction space at a location within a range of 0.1 to 0.6 mm in said axial direction from where said projections extending radially inward from said first end surface of said vanes to said central axis would lie.

2. A magnetron in accordance with claim 1, wherein said first end shield is so provided that said inner surface of said flange part is located in a position in said interaction space by a distance within a range of 0.2 to 0.4 mm along said axial direction from where a projection extending radially inward from said first end surfaces of said vanes to said axis would lie.

3. A magnetron in accordance with claim 1, wherein said basic frequency is within a range of 2400 to 2500 MHz.

4. A magnetron in accordance with claim 1, wherein said basic frequency is at 2450 MHz.

5. A magnetron in accordance with claim 1, wherein said strap means has an inner peripheral surface, said suppressing means including an arrangement in which a distance between said inner peripheral surface of said strap ring means and said edge of said vanes to a length of said vanes define a ratio l/L that exceeds a predetermined minimum value for suppressing generation of the fifth harmonic, where l represents said distance and L represents said length which is an extent to which said vanes extend from said anode to said edge.

6. A magnetron in accordance with claim 5, wherein said l/L ratio is within a range of at least 21% and at most 32%.

7. A magnetron in accordance with claim 5, wherein said basic frequency is within a range of 2400 to 2500 MHz.

8. A magnetron in accordance with claim 5, wherein said basic frequency is at 2450 MHz.

9. A magnetron in accordance with claim 5, wherein said l/L ratio is within a range of at least 18% and at most 35%.

10. A magnetron in accordance with claim 1, wherein said antenna conductor has a side facing said anode, said first end shield being located to said side of said antenna conductor.

11. A magnetron for generating microwaves of a predetermined basic frequency and which harmonics higher than the basic frequency also may be produced, the magnetron comprising:

an anode having a cylindrical shape relative to a central axis;

a cathode extending radially inside of said anode and extending in an axial direction along said central axis, said cathode having a filament defined by a width and first and second ends between which said filament extends along said central axis, said cathode having a first end shield which supports said first end of said filament, said first end shield having a flange part with an outer diameter which is greater than the width of said filament, said cathode also having a second end shield which supports said second end of said filament;

a plurality of panel-shaped vanes extending from said anode towards said central axis, each of said vanes being spaced from each other and having a periphery which includes first and second end surface which extend from said anode towards said central axis, each said periphery also including an edge extending between said first and second end surfaces, said vanes being spaced from said cathode so as to define an interaction space bounded between said edge, said cathode, and where projections extending radially inward from said first and second end surfaces to said central axis would lie, an antenna conductor electrically connected to said first end surfaces of one of said vanes and extending in said axial direction;

strap ring means for electrically coupling alternate ones of said vanes with each other at said first end surfaces; and magnetic field providing means for providing a magnetic field in said interaction space, said magnetic field providing means including opposing magnetic elements, said anode and said interaction space being between said opposing magnetic elements of said magnetic field providing means, said flange part of said first end shield having an inner surface being within said interaction space for suppressing generation of a fifth harmonic by being at a location within a range of 0.1 to 0.6 mm in said axial direction from where said projection extending radially inward from said first end surface of said vanes to said central axis would lie.

12. A magnetron in accordance with claim 11, wherein said first end shield is so provided that said inner surface of said flange part is located in a position in said interaction space by a distance within a range of 0.2 to 0.4 mm along said axial direction from where a projection extending radially inward from said first end surfaces of said vanes to said axis would lie.

13. A magnetron in accordance with claim 11, wherein said antenna conductor has a side facing said anode, said first end shield being located to said side of said antenna conductor.

14. A magnetron in accordance with claim 11, wherein said strap ring means has an inner peripheral surface, a distance l between said inner peripheral surface of said strap ring means and said edge of said vanes to a length L of said vanes defining a ration l/L that exceeds a predetermined minimum value for suppressing generation of the fifth harmonic, where l represents said distance and L represents said length which is an extent to which said vanes extend from said anode to said edge.

15. A magnetron in accordance with claim 14, wherein said l/L ratio is within a range of at least 18% and at most 35%.

16. A magnetron in accordance with claim 14, wherein said l/L ratio is within a range of at least 21% and at most 32%.

* * * * *